United States Patent [19]

Schafer et al.

[11] 4,454,860

[45] Jun. 19, 1984

[54] FUEL STOKER AND FURNACE

[75] Inventors: Tony L. Schafer, Dickinson, N. Dak.; Stephen A. Schafer; Gregory L. Schafer, both of Box 1382, Dickinson, N. Dak. 58601; H. Darwin Swett, Dickinson, N. Dak.

[73] Assignees: Stephen A. Schafer; Gregory L. Schafer, both of Dickinson, N. Dak.

[21] Appl. No.: 490,774

[22] Filed: May 2, 1983

Related U.S. Application Data

[63] Continuation of Ser. No. 309,245, Oct. 7, 1981, abandoned, which is a continuation-in-part of Ser. No. 240,213, Mar. 3, 1981, abandoned.

[51] Int. Cl.[3] ..... F24H 3/06

[52] U.S. Cl. ..... 126/110 R; 110/288; 110/165 R; 126/182

[58] Field of Search ..... 110/216, 288, 182, 165 R, 110/170, 247; 126/110 R, 98 R, 110 AA, 182

[56] References Cited

U.S. PATENT DOCUMENTS

| | | | |
|---|---|---|---|
| Re. 19,693 | 9/1935 | Best | 110/288 |
| 945,825 | 1/1910 | Wallis | 126/182 |
| 2,141,764 | 12/1938 | Riddell | 110/288 |
| 2,191,219 | 2/1940 | Peltz | 110/288 |
| 2,255,373 | 9/1941 | Blake | 126/182 |
| 2,780,187 | 2/1957 | Birch | 110/165 R |
| 3,742,874 | 7/1973 | Eff | 110/216 |
| 3,835,817 | 9/1974 | Tuomaola | 122/379 |
| 4,007,697 | 2/1977 | Prill | 110/288 |
| 4,078,541 | 3/1978 | Roycraft | 110/260 |
| 4,137,051 | 1/1979 | Godwin | 110/247 |

*Primary Examiner*—Henry C. Yuen
*Attorney, Agent, or Firm*—Robert W. Gutenkauf

[57] ABSTRACT

A furnace having a primary heat exchange unit also providing a combustion chamber, a secondary heat exchange unit connected by an upper crossover conduit to the primary heat exchange unit, and a tertiary heat exchange unit connected by a lower V-shaped crossover conduit to the secondary heat exchange unit. A third crossover conduit connects the V-shaped crossover conduit with the primary heat exchange unit. A fly ash removal screw is located in the V-shaped crossover conduit to move fly ash therefrom through the third crossover conduit back into the primary heat exchange unit to an ash depository for removal therefrom. Vibrating means are provided between the secondary and tertiary heat exchange units to vibrate the walls thereof and dislodge clinging fly ash so that it falls into the V-shaped crossover conduit for removal by the screw conveyor. A burner assembly of the furnace includes a combustion air housing carrying a circular, stationary grate with an annular valley for carrying fuel during combustion. A central opening is connected to a fuel conveyor for introduction of fuel to the grate through the lower portion of the housing. Combustion air introduction conduits on the housing are remote from the fuel introduction passages and introduce air under pressure at the lower portion of the grate. An agitator and discharge ring is provided on the grate and is rotated on the grate by a suitable drive sprocket mechanism to agitate the fuel for more complete burning thereof and to remove burned ash.

12 Claims, 14 Drawing Figures

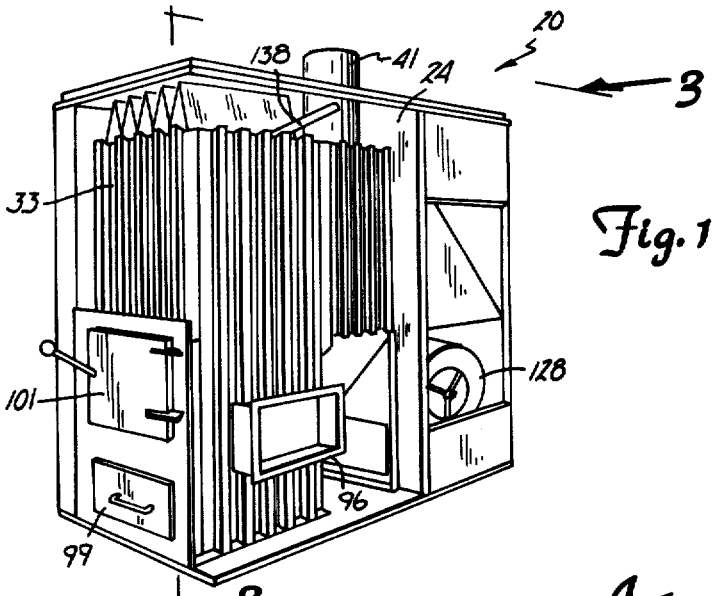
Fig. 1
Fig. 3
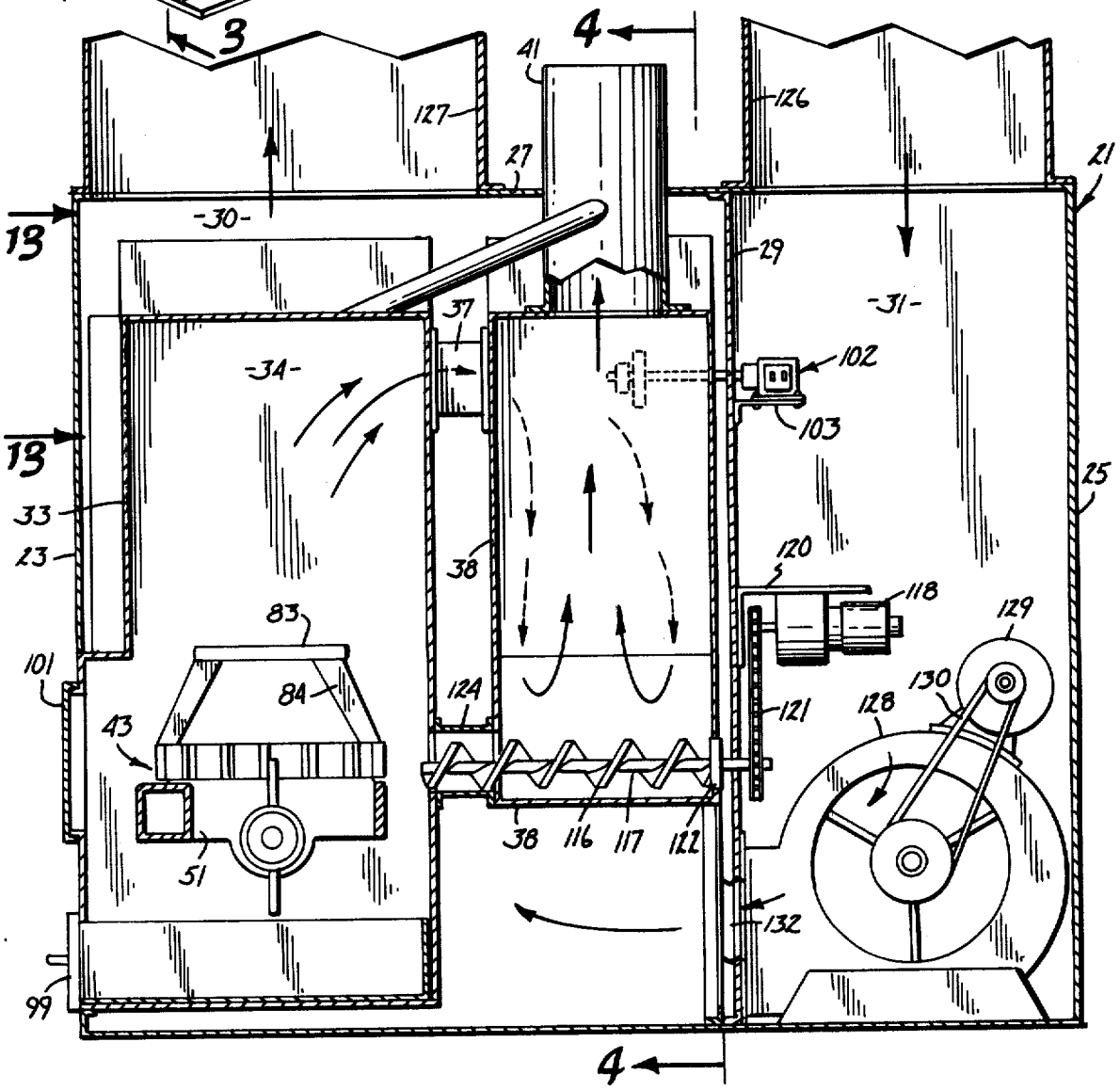

FUEL STOKER AND FURNACE

This is a continuation of application Ser. No. 309,245 filed Oct. 7, 1981 now abandoned. Application Ser. No. 309,245 is a continuation-in-part of application Ser. No. 240,213 filed Mar. 3, 1981, now abandoned.

BACKGROUND OF THE INVENTION

The invention pertains to a furnace and a stoker for a furnace which uses combustion air supplied by a blower, and fuel fed by a conveyor screw inserted into a hot air heat exchanger. The furnace is particularly adaptable for use in domestic and commercial heating, but is also adaptable in commercial and agricultural drying applications.

In prior art furnaces, solid fuels such as bio-mass pellets and coal are burned in a number of ways. Stoker assemblies are provided which convey fuel to the surface of a rotating annular grate disposed in an angular plane allowing accumulated ash to fall off the lower edge of the grate by gravity. Such assemblies result in the formation of large clinkers when burning coal and are also inefficient with regard to achieving complete combustion of the fuel.

In other types of the devices, a fire port is utilized having an enclosed lower retort portion which continues upward and has openings which constitute a tuyere. Clinker formation is enhanced when coal is burned inside such an enclosure. In such devices in which combustion air is fed into the sides or bottom of the retort, there is a risk that, during the idle cycle of the device, a cap of clinkers may form at the top of the pot diverting combustion air into the fuel conveyor mechanism, igniting fuel therein. If not discovered early, this process can continue until ignition progresses through the fuel conveyor to the fuel storage bin.

Another variety of stoker mechanisms utilizes a flat, stationary grate system and employs apparatus for fuel to enter one side of the grate, be transported across the grate upon which combustion takes place, and thence, as ash, to fall by gravity into a suitable container or removal conveyor. These devices are wasteful insofar as they do not achieve complete combustion of the fuel. Additionally, such devices, through the manner in which fresh fuel is co-mingled with burning fuel, create an inordinate amount of noxious emissions which generally cannot later be modified in the burning process and which thus enter the atmosphere as pollutants.

Some burning devices incorporate mechanism for secondary combustion of gases given off by heated fuels or partially burned fuels. These mechanisms are cumbersome, require periodic adjustment and a separate combustion air source also subject to adjustment, and are only partially successful in achieving secondary combustion of gases.

A further burning device incorporates a circular, horizontal stationary grate upon which a concentric ring with dependent teeth is caused to periodically rotate when engaged by a drive sprocket. The object of the concentric ring is to break up and discharge clinkers and ash formed in the combustion process. Because of the upward angle in which the drive sprocket tooth attacks the dependent teeth on the concentric ring, the ring is frequently lifted from the grate and becomes either jammed or dislodged causing malfunction of the entire apparatus.

A disadvantage shared by all stoker fed burning devices using combustion air supplied by a blower is the creation, in the burning process, of a quantity of finely divided particulate matter commonly called fly ash. In most such burning devices fly ash is caught up in the exhaust gases of the device and eventually is expelled into the atmosphere.

According to the present invention, there is provided a furnace having a primary heat exchange unit serving also as a combustion chamber, a secondary heat exchange unit connected by an upper crossover conduit to the primary heat exchange unit, and a tertiary heat exchange unit connected by a lower crossover conduit to the secondary heat exchange unit. A screw conveyor is provided to convey solid fuel such as coal to a burner assembly located in the combustion chamber. The burner assembly includes a combustion air housing carrying a circular, stationary grate having an annular valley for carrying fuel during combustion. The housing has a central opening which is connected to the fuel conveyor for introduction of fuel to the grate through the lower portion of the housing. The housing also has combustion air introduction conduits which introduce air under pressure at the lower portion of the grate. An agitator and discharge ring is situated on the grate and is rotated on the grate by a suitable drive sprocket mechanism connected to the screw conveyor. A horizontal burner plate is supported on the discharge ring by suitable legs and is disposed above the grate to promote more complete combustion of the fuel.

A fly ash removal assembly is located in the lower crossover conduit between the secondary and tertiary heat exchangers and includes an actuator for vibration of the walls of the heat exchanger to loosen fly ash and cause it to drop to the lower portion of the crossover conduit where it is carried by a fly ash conveyor screw to the primary heat exchange unit for disposal along with spent ashes.

The burner assembly provides for the inhibition of the formation of all but very small clinkers, an extremely high degree of reliability and operation, simple and relatively inexpensive construction, adaptability to a wide variety of sizes and uses, and substantially complete combustion of both solid fuel as well as combustible gases produced by burning solid fuels. Maximum heat recovery is achieved in the ommission of potentially dangerous pollutants into the atmosphere is minimized.

Additionally, fly ash is deflected away from the main current of the combustion gases emitted into the atmosphere as exhaust, and pollution from fine and particulate matter is substantially reduced.

IN THE DRAWINGS

FIG. 1 is a perspective view of a furnace according to the invention with certain side walls and the stoker and burner assemblies removed for purposes of illustration;

FIG. 3 is an enlarged sectional view of the furnace of FIG. 1 taken along the line 3—3 thereof;

DESCRIPTION OF A PREFERRED EMBODIMENT

Figure 2:
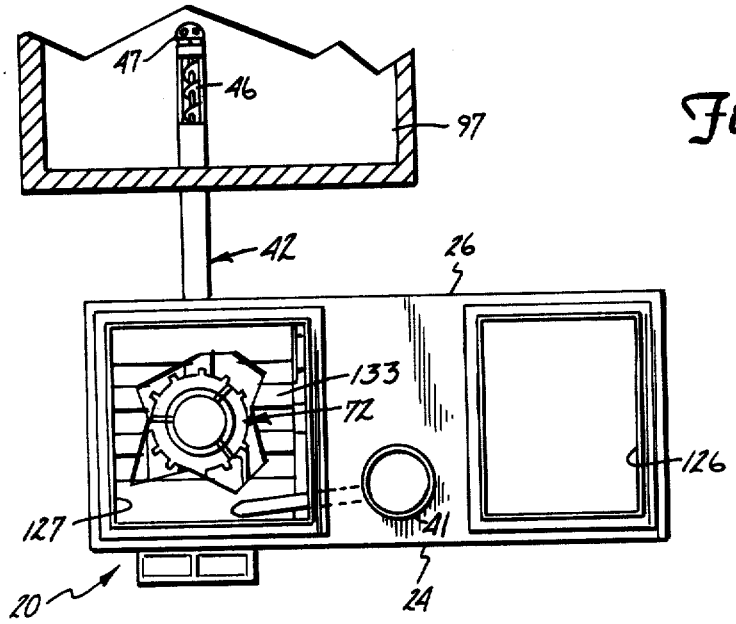
FIG. 2 is an enlarged top plan view of the furnace of FIG. 1.
Figure 4:
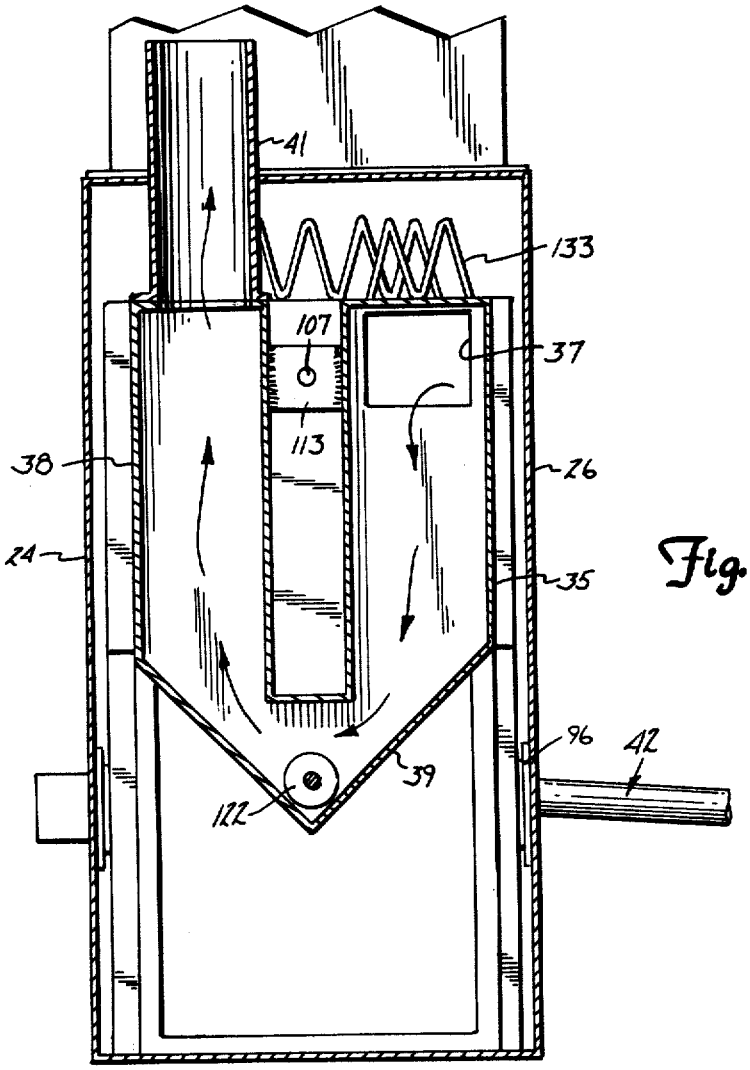
FIG. 4 is a sectional view of the furnace as shown in FIG. 3 taken along the line 4—4 thereof.

Referring to the drawings, there is shown in FIGS. 1 through 3 a hot air furnace 20 according to the invention having a furnace cabinet or housing 21 comprised of side walls 23 through 26 and a top wall 27. An intermediate vertical wall 29 separates cabinet 11 into a furnace compartment 30 and a blower compartment 31. A heat exchange assembly for furnace 20 located in furnace compartment 30 of cabinet 21 includes a primary heat exchange unit 33 which also defines a combustion chamber 34. A secondary heat exchange unit 35 is located adjacent primary heat exchange unit 33 and is connected to it by an upper crossover conduit 37 (FIG. 4). A tertiary heat exchange unit 38 is located adjacent secondary heat exchange unit 35 and is connected to it by a triangularly shaped crossover conduit 39. Lower crossover conduit 39 has a downwardly directed apex and extends substantially the length of both secondary and tertiary heat exchange units 35, 38. Secondary and tertiary heat exchange units 35, 38 are disposed in side-by-side relationship both in facing relationship to primary heat exchange unit 33. A combustion gas exhaust flue 41 extends from the upper wall of tertiary heat exchanger 38, outside of cabinet 21 to a place of exhaust. Exhaust products produced in combustion chamber 34 follow a path through the upper crossover conduit 37 to the secondary heat exchanger 35 downwardly through the lower crossover conduit 39 and then into tertiary heat exchanger 38 where they are then exhausted through flue 41.

Figure 5:
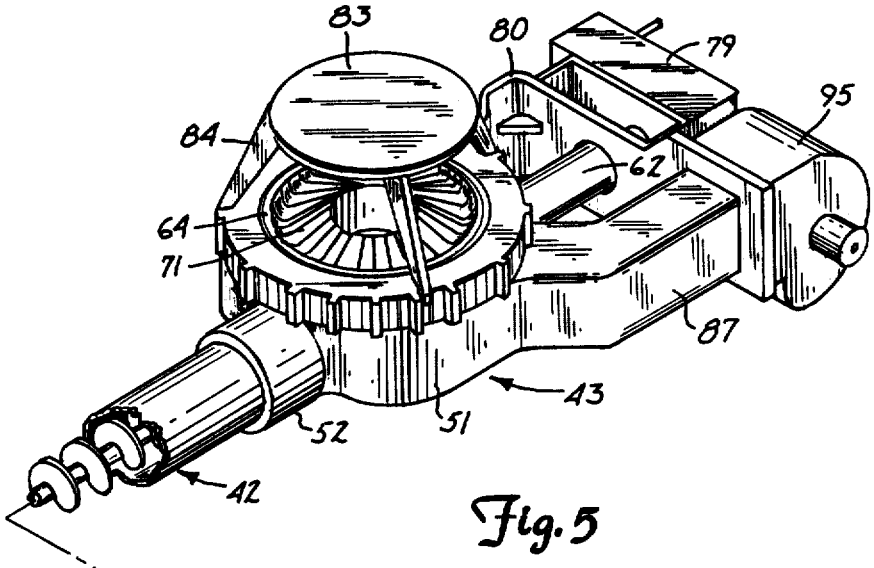
FIG. 5 is a perspective view of the stoker and burner assemblies of the furnace of FIG. 1.

Referring to FIG. 5, there is shown in perspective a fuel screw conveyor assembly 42 connected to a burner assembly 43. Fuel screw conveyor assembly 42 includes a tubular housing 44 partially enclosing a screw conveyor 46. An end plate 47 is located at the end of tube 44 and is held by leveling screws 48. The flight of screw conveyor 46 is carried on a rotatable screw conveyor shaft 49 which extends from end plate 47 to burner assembly 43.

As shown in FIGS. 5 through 9, burner assembly 43 includes a combustion air housing 51 having a circular neck or fuel port 52 for telescopic connection to the end of tube 44 of conveyor assembly 42 providing a fuel entry port to the burner assembly 43. Combustion air housing 51 has a central fuel orifice 53 open to the fuel port 52 for the introduction to the burner assembly of solid fuel conveyed by conveyor assembly 42.

An end portion of shaft 49 of screw conveyor 46 is located in a bearing support opening 55 of housing 51. The tip 56 of shaft 49 is externally squared and extends outwardly of bearing support 55 into an internally squared end opening 59 of a ring rotating sprocket 60. A fuel conveyor shaft washer 57 is disposed between sprocket 60 and bearing support 55.

Figure 7:
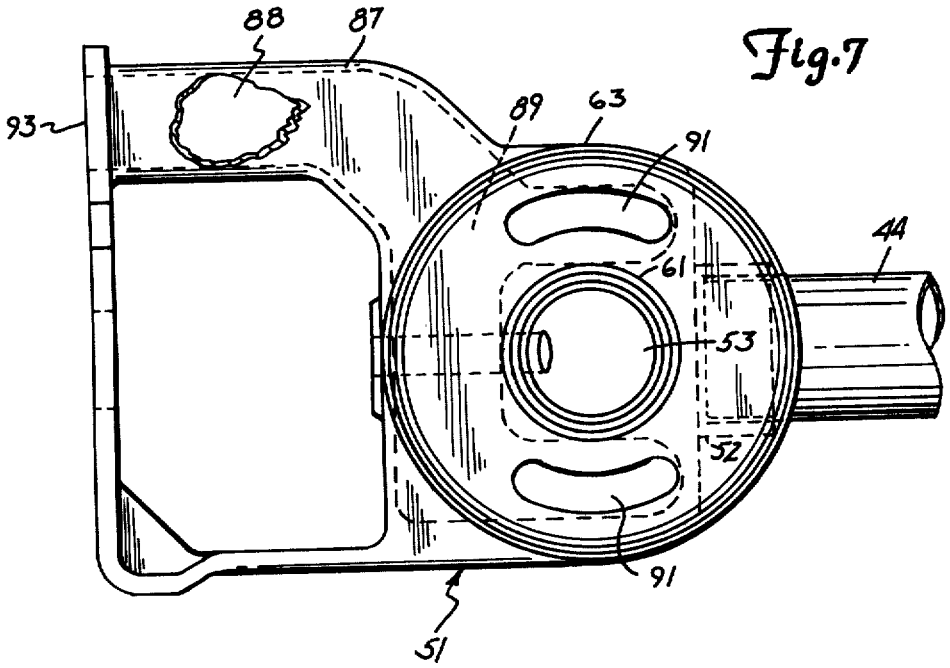
FIG. 7 is a top plan view of the burner housing of the burner assembly as shown in FIG. 6.
Figure 8:
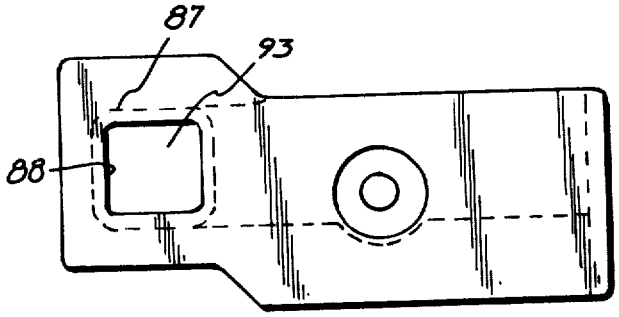
FIG. 8 is an end view of the burner housing of FIG. 7.

The upper surface of the combustion air housing 51 is a generally circular surface with a first pair of concentric circular flanges 61 in close surrounding relationship to fuel orifice 53 (see FIG. 7). A second pair of concentric flanges 63 is located in radially spaced relationship from the first pair 61. An annular fuel grate 64 is positioned on the upper surface of combustion air housing 51. Grate 64 has an interior annular wall 65 with a lower tapered edge fitted into the valley between the flanges of the first pair 61 to form a grate seal. Grate 64 has an outer annular wall 67 having a tapered lower edge to fit in the valley between the second or outer pair of flanges 63 providing an outer grate seal. Grate 64 has a contoured surface between the inner and outer walls 65, 67 forming an annular burning trough 68. Trough 68 has a downwardly sloping surface extending from the upper edge of inner wall 65 to a trough bottom where the surface turns abruptly upward toward the upper edge of outer wall 67. A circumferential horizontal bearing support ledge 69 is located at the upper edge of outer wall 67.

A plurality of radially extending openings 71 are provided in trough 68 extended between the edges of inner and outer walls 65, 67.

An annular agitator and discharge ring 72 is coaxially mounted on bearing ledge 69 of grate 64 for rotation thereon. Discharge ring 72 is centrally open over grate 64 and has an outer planar horizontal rim 73 in contact with bearing support ledge 69. A vertical side wall 74 extends downwardly from the horizontal rim 73 in straddling relationship to the outer wall 67 of grate 64. A plurality of vertical teeth 76 extend outwardly from vertical wall 74 and are equally spaced about the perimeter thereof. The inner upper edge of discharge ring 72 is beveled at an angle of approximately 54 degrees.

Figure 10:
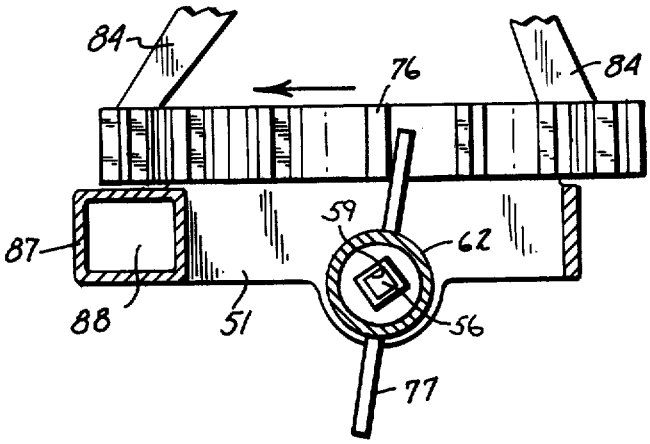
FIG. 10 is a sectional view of a portion of the stoker and burner assembly shown in FIG. 9 taken along the line 10—10 thereof.

Ring rotating sprocket 60 includes a tubular shaft 62 and diametrically aligned generally radially extending teeth 77. More or less teeth could be provided. Shaft 62 is at a slight inclination to the horizontal in axial alignment with the conveyor shaft 49 of fuel screw conveyor 46. Sprocket teeth 77 extend from shaft 62 angularly so as to be vertically orientated when rotated to the upper side of shaft 62. As shown in FIG. 10, the sprocket teeth 77 have sufficient length and are purposefully orientated so as to enable engagement of a sprocket tooth 77 with a discharge ring tooth 76 at a position at or slightly above a medium line through the body of the agitator and discharge ring 72. This relative positioning avoids disengagement of the agitator and discharge ring 72 upon being rotated by ring rotating sprocket 60.

Figure 9:
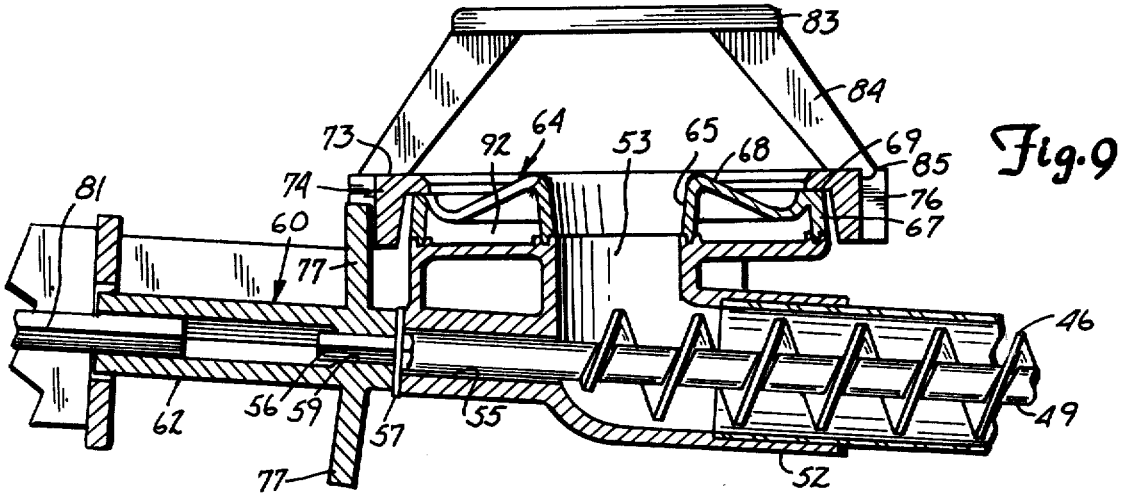
FIG. 9 is a sectional view of the portions of the stoker and burner assemblies of FIG. 6 taken along the line 9—9 thereof.

As shown in FIG. 5, a gear reduction box 79 is mounted on a plate 80 connected to the combustion air housing 51. Gear reduction box 79 has an output shaft 81 which is externally squared and is connected to the internally squared end of shaft 62 of ring rotating sprocket 60 (FIG. 9). Gear reduction box 79 is operated by a suitable variable speed electric motor (not shown) to rotate output shaft 81 which results in rotation of ring rotating sprocket 60. Rotation of ring rotating sprocket 60 results in rotation of the agitator and discharge ring through the teeth 77 engaging the discharge ring teeth 76. At the same time, rotation of the ring rotating sprocket 60 results in rotation of the shaft 49 of fuel screw conveyor 46 to deliver fuel to the fuel orifice 53 of combustion air housing 51.

A round, flat horizontally disposed combustion burner plate 83 is supported by a plurality of legs 84 in position horizontally spaced above the burner grate 64. Each leg 84 has an upper end connected to the lower surface of plate 83, and a lower end in engagement with the upper horizontal surface 73 of agitator and discharge ring 72. A stabilizing tooth 85 on each leg 84 extends over the edge of horizontal surface 73 of agitator ring 72 to further secure the legs 84 and plate 83 in place.

Combustion air housing 51 is formed with a combustion air duct 87 providing a combustion air passage 88 to a chamber 89 located beneath grate 64 in housing 51. Air passage 88 is remote from fuel entry port 52 of housing 51. A pair of combustion air apertures 91 are located on the top surface of combustion air housing 51 open to chamber 89 below, and open to a pressurized air space 92 located above the top wall of housing 51 and beneath grate 64 (FIGS. 7 and 9).

As shown in FIG. 5, a combustion air blower 95 with a self-contained motor is mounted on plate 80 with a discharge aligned with the inlet opening 93 to duct 87 to provide combustion air to the combustion air housing 51, through the passage 88, to the chamber 89, through combustion air apertures 91 to the pressurized space 92. Air is then available to pass through the openings 71 in grate 64 for combustion in the trough 68.

Figure 6:
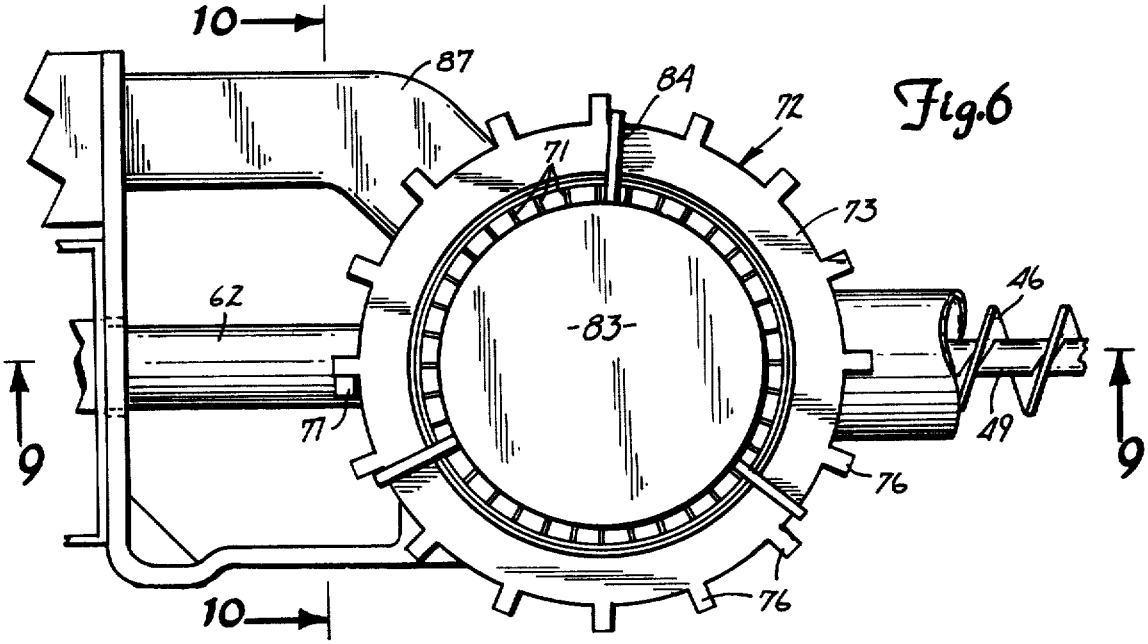
FIG. 6 is an enlarged top plan view of a portion of the stoker and burner assemblies of FIG. 5.

Primary heat exchange unit 33 has two identical, symmetrically positioned stoker ports 96 located on opposite side walls so that the screw conveyor and burner assemblies can be installed therein with the screw conveyor assembly extended from either side. In installed fashion, approximately that much of the screw conveyor and burner assemblies shown in FIGS. 6 are located inside the combustion chamber 34 with the plate 80 closing one stoker port and the screw conveyor housing 44 extending through the other with suitable closure means around it (not shown). Burner assembly 43 is positioned centrally within the combustion chamber 34. The intake end of the fuel screw conveyor 46 is placed within an existing fuel bin. The fuel screw conveyor intake end is provided with the end plate 47 attached to the fuel screw conveyor tube 44 which serves as a thrust bearing for the screw conveyor shaft 49. The screw conveyor end plate 47 is provided with two leveling screws 48 which are adjusted to align the screw conveyor to an upward slope from intake end to discharge end of approximately 4 degrees. When this adjustment is achieved, the agitator and discharge ring 72, and the combustion burner plate 83, both attached at the discharge end of the fuel screw conveyor, are substantially level.

Fuel from a bin, indicated at 97 in FIG. 2, is picked up by the screw conveyor and transported upwardly into the combustion chamber 34. The screw conveyor moves the fuel up to the fuel orifice 53 of air combustion housing 51. The fuel moves into the trough of grate 64 for combustion. Combustion air is provided through the duct 87, into the chamber 89, through the combustion air apertures 91 to the pressurized air space 92. This air rises through the openings 71 of grate 64 for mixture and combustion of the fuel located therein.

Screw conveyor shaft 49 is rotated by ring rotating sprocket 60 which is rotated by output shaft 81 of gear box 79. At the same time, sprocket teeth 77 rotate to positions in engagement with the agitator and discharge ring teeth 74 to rotate the agitator and discharge ring on the bearing support surface 69 of grate 64. Grate 64 is sealed with respect to the upper surface of air combustion housing 51 at the inner and outer flanges 61, 63 whereby combustion air does not mix with the fuel until the combustion air passes through the lower openings 71 of the grate 64.

The inner margin or edge of the agitator and discharge ring 72 is flat to form a rotating wall which, through friction with fuel lumps and particles, transmits movement to the mass of fuel. This movement of the fuel mass inhibits the formation of clinkers and assures complete exposure of all elements of the fuel mass to combustion air for efficient combustion. Also, upon rotation, the agitator and discharge ring 72, by gravity, discharges accumulated ash from its flat planar upper surface which accumulates in an ash drawer 99 located just beneath it (FIG. 3) which can be periodically removed and emptied. Access to the interior of combustion chamber 34 can be had through door 101 for purposes of servicing burner assembly 43 or the like.

During combustion in grate 64, heated gases, some of which are combustible, and fly ash, are forced upward and inward by the force of combustion air perculating through the burning fuel mass. These products are deflected outward and downward by the combustion burner plate. These combustible gases are forced to pass through the area of combustion and are consumed in the flames emanating from the burning fuel mass. Much of the fly ash is deflected into the ash pan or drawer 99 located beneath the burner assembly 43.

Figure 11:
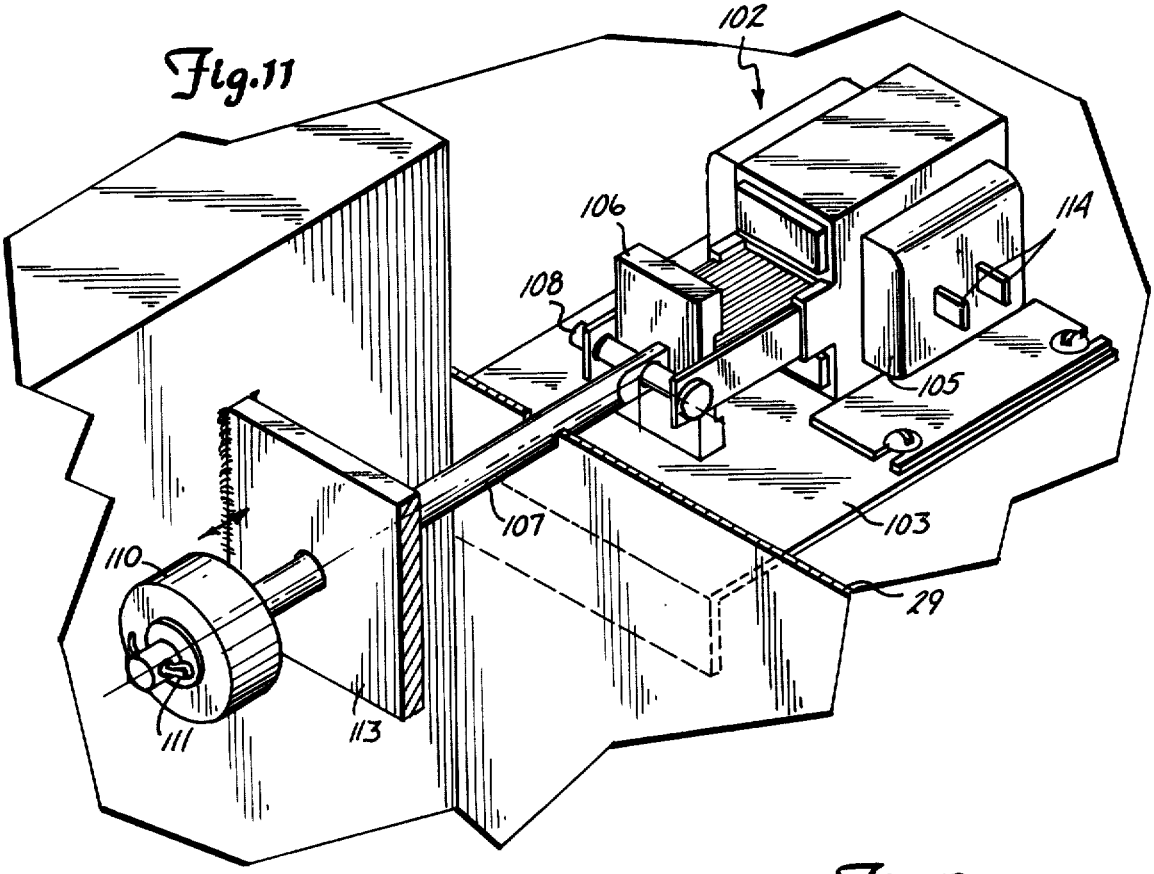
FIG. 11 is a perspective view of the actuating device of the fly ash removal assembly of the furnace of the invention.
Figure 12:
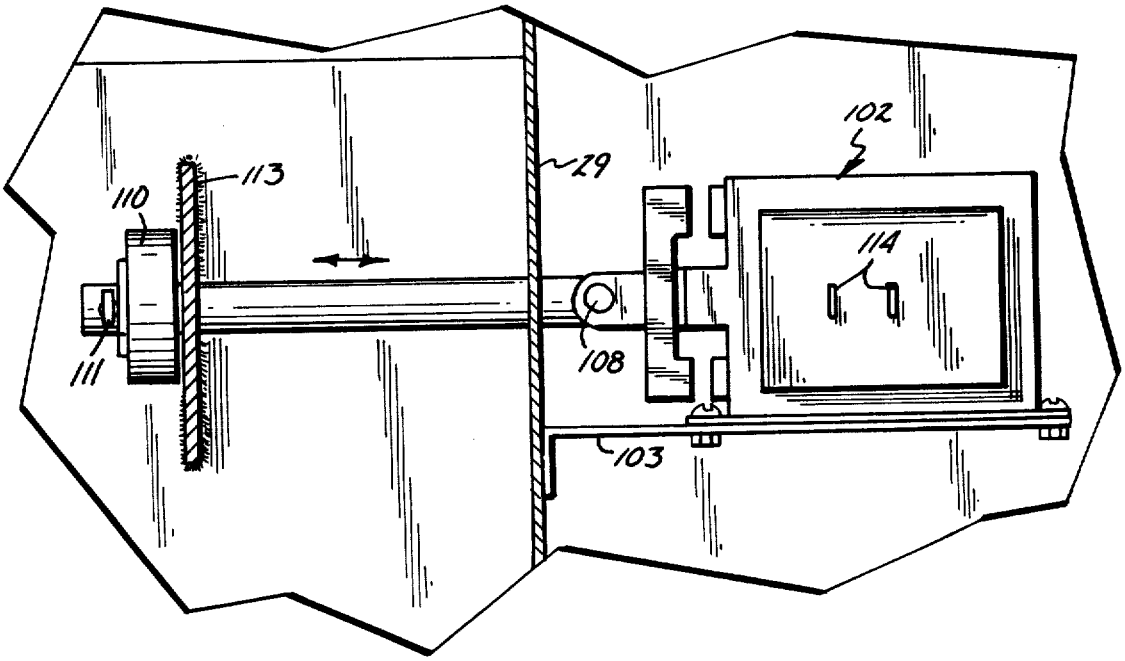
FIG. 12 is a side elevational view of the actuating device as shown in FIG. 11.

Fly ash removal apparatus is mounted between secondary and tertiary heat exchange units 35, 38 for the purpose of removing fly ash collected on the interior walls of the heat exchange units and moving it to ash drawer 99 in primary heat exchange unit 33. As shown in FIG. 3, a vibrating device 102 is mounted on a shelf 103 fixed to intermediate wall 29 in blower compartment 31 of furnace cabinet 21. As shown in FIGS. 11 and 12, vibrating device 102 includes an electric motor comprised as a solenoid coil 105 attached to a yoke 106 which is in turn attached to a vibrating rod 107 by means of a solenoid yoke pin 108. A hammer 110 is attached to the end of vibrating rod 107 by means of a cotter pin 111. The vibrating rod extends through a suitably provided opening in a heat exchange striker plate 113. As shown in FIG. 4, heat exchange striker plate 113 is located between and attached to adjacent walls of the secondary and tertiary heat exchange units 35, 37. The solenoid coil 105 is periodically actuated by electricity through terminals 114. When actuated, rod 107 moves back and forth resulting in hammer 110 striking heat exchanger strike plate 113 causing vibrations in the walls of secondary and tertiary heat exchange units 35, 38 causing fly ash to be dislodged therefrom and fall to the bottom or crossover conduit 39.

The fly ash removal assembly includes a horizontally orientated fly ash conveyor screw 116 mounted in the lower V-shaped crossover conduit 39. Conveyor screw 116 is comprised as a helical flight mounted on a shaft 117. A conveyor screw drive motor 118 is mounted on a bracket 120 secured to intermediate wall 129 in blower compartment 31. The output shaft of motor 118 is connected to a sprocket chain 121 which is connected to one end of shaft 117 of conveyor screw 116 for rotation thereof. Shaft 117 extends through a suitable opening in intermediate wall 29 and the wall of crossover conduit 39 at the juncture of secondary and tertiary heat exchange units 35, 38. The opposite end of lower V-shaped crossover conduit 39 has an opening 123 to a connecting tube 124 which opens into combustion chamber 34 at a point located above ash drawer 99. Fly ash that falls by gravity into the V-shaped crossover conduit 39 is conveyed by screw conveyor 116 into the combustion chamber of primary heat exchange element 33 where it is deposited in the ash drawer 99 for periodic removal. Motor 118, along with vibrating device 102, can be automatically operated periodically as may be required to remove fly ash as may build up.

Figure 13:
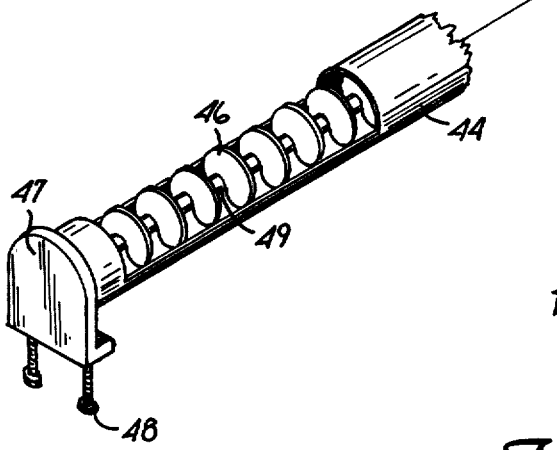
FIG. 13 is an enlarged side elevational view of a portion of the furnace shown in FIG. 3 taken along the line 13—13 thereof.
Figure 13:
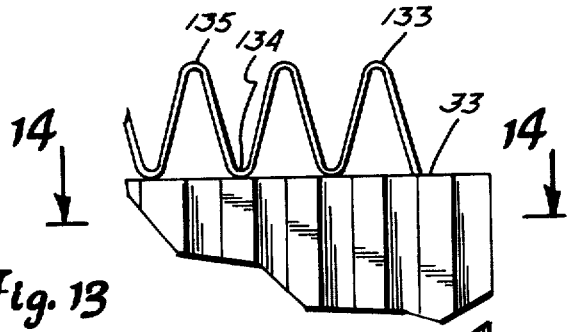
Figure 14:
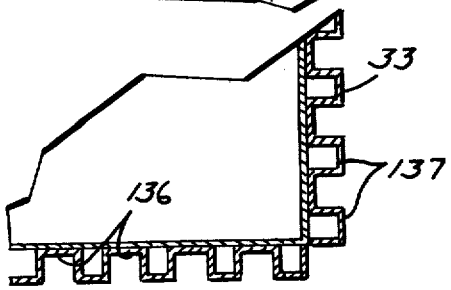
FIG. 14 is a sectional view of a portion of the furnace assembly shown in FIG. 13 taken along the line 14—14 thereof.

A cold air plenum 126 empties into the blower compartment 31 of furnace cabinet 21, drawing air that has cooled from various conventional sources in the building. An air blower 128 is mounted in the lower compartment 31 and is properly connected to a conventional motor 129 by a belt 130 to move air from the blower compartment 31 through an opening 32 in intermediate wall 29 to the furnace compartment 30. A warm air plenum 127 extends from the upper portion of the furnace compartment 30 to the usual warm air distribution system of the building. As the air passes through the furnace compartment 30, it is warmed as it comes in contact with the primary, secondary and tertiary heat exchange units. Heat transfer from the heat exchange units to the passing air can be enhanced by a sinuate heat exchanger plate 133 placed on the top wall of the heat exchanger units as shown in FIGS. 1, 3, 4 and 14. Plate 133, as shown in FIG. 13, consists of alternate valleys 134 and crests 135. In addition, to enhance heat conduction from the heat exchange units, the walls of the heat exchange units can have a sinuate cross-sectional profile, for example, as shown in FIG. 14 where the wall of primary heat exchange unit 33 is shown to have a wall with a square wave-shape cross section formed of alternating rectangular shaped channels 136 and ridges 137.

In use, fuel conveyor assembly 42 delivers fuel to burner assembly 43 for combustion on grate 64 as previously described. Fuel and combustion air are isolated except at the point of combustion. Agitator and discharge ring 72 operates to prevent clinkers, expose maximum fuel surface to combustion, and discharge ashes to ash drawer 99. As ring rotating sprocket teeth 77 engage the agitator and discharge ring teeth 76 at a point higher than one-half of the distance measured from bottom to top of the vertical surface of the agitator and discharge ring, stability of rotation in a narrowly defined plane is assured. Burner plate 83 deflects uncombusted products of combustion back through the area of combustion for more complete combustion. Heated products of combustion travel upwardly in combustion chamber 34, through upper crossover conduit 37 into the secondary heat exchange unit 35. These products of combustion then travel downwardly in the secondary heat exchange unit 35 through the lower V-shaped crossover conduit 39 into the tertiary heat exchange unit 38 and then up through the flue 41. During the process, heat is extracted from the heat exchangers by air moving from the cold air intake plenum 126 through the blower compartment 31, then into the furnace compartment 30. As the air circulates through the furnace compartment 30, it is heated by the heat exchange units. This heated air then travels through the warm air outlet plenum 127 to the usual warm air distribution system of the building.

Periodically, vibrating device 102 is operated to remove fly ash that may be clinging to the interior walls of the secondary and tertiary heat exchange units 35, 38. This fly ash is dropped by gravity into the V-shaped crossover conduit 39 where it is carried by the fly ash screw conveyor 116 into the combustion chamber 34 to be dropped into the ash drawer 99.

A combustion gas safety vent 138 is connected directly between the upper portion of combustion chamber 34 and the flue 41 to prevent an excessive build-up of products of combustion in the combustion chamber 34.

While there has been shown and described a preferred embodiment of a furnace according to the invention, it is understood that certain deviations can be had by those skilled in the art without departing from the scope and spirit of the invention.

The embodiments of the invention in which an exclusive property or privilege is claimed are defined as follows:

1. A hot air furnace for burning solid fuel comprising:

a furnace cabinet having walls defining a furnace compartment;

a primary heat exchange unit located in the furnace compartment and defining a combustion chamber;

a solid fuel burner assembly located in the combustion chamber;

a fuel ash depository located beneath the burner assembly for collection of ash produced as a result of burning fuel;

a secondary heat exchange unit positioned adjacent the primary heat exchange unit having an interior for receipt of products of combustion from the primary heat exchange unit;

an upper crossover conduit connecting the upper portion of the interior of the primary heat exchange unit and the upper portion of the interior of the secondary heat exchange unit;

a tertiary heat exchange unit positioned adjacent the secondary heat exchange unit and positioned so that the secondary heat exchange unit and tertiary heat exchange unit are in side-by-side relationship facing the primary heat exchange unit, said tertiary heat exchange unit having an interior for receipt of products of combustion from the secondary heat exchange unit;

a lower generally V-shaped crossover conduit connecting the lower portion of the interior of the secondary heat exchange unit to the lower portion of the interior of the tertiary heat exchange unit along the length thereof in the direction facing the primary heat exchange unit;

a third crossover conduit extended between the primary heat exchange unit and the secondary and tertiary heat exchange units, open at one end to the generally V-shaped crossover conduit and at the opposite end to the lower portion of the combustion chamber of the primary heat exchange unit proximate the fuel ash depository;

a fly ash conveyor screw assembly including a fly ash conveyor screw rotatably located in the generally V-shaped crossover conduit and extending through the third crossover conduit operative to move fly ash from the generally V-shaped crossover conduit through the third crossover conduit to be deposited in the ash depository located in the primary heat exchange unit;

means for selective rotation of the fly ash screw conveyor;

the walls of the secondary and tertiary heat exchange units being adapted for vibration thereof to dislodge fly ash and cause it to drop by gravity into the generally V-shaped crossover conduit;

means for vibration of the walls of the secondary and tertiary heat exchange units; and flue means communicative with the tertiary heat exchange unit for discharge of products of combustion.

2. A hot air furnace for burning solid fuel comprising:

a furnace cabinet having walls defining a furnace compartment;

a primary heat exchange unit located in the furnace compartment and defining a combustion chamber;

a solid fuel burner assembly located in the combustion chamber;

a fuel ash depository located beneath the burner assembly for collection of ash produced as a result of burning fuel;

a secondary heat exchange unit positioned adjacent the primary heat exchange unit having an interior for receipt of products of combustion from the primary heat exchange unit;

an upper crossover conduit connecting the upper portion of the interior of the primary heat exchange unit and the upper portion of the interior of the secondary heat exchange unit;

a tertiary heat exchange unit positioned adjacent the secondary heat exchange unit and positioned so that the secondary heat exchange unit and tertiary heat exchange unit are in side-by-side relationship facing the primary heat exchange unit, said tertiary heat exchange unit having an interior for receipt of products of combustion from the secondary heat exchange unit;

a lower generally V-shaped crossover conduit connecting the lower portion of the interior of the secondary heat exchange unit to the lower portion of the interior of the tertiary heat exchange unit along the length thereof in the direction facing the primary heat exchange unit;

a third crossover conduit extended between the primary heat exchange unit and the secondary and tertiary heat exchange unit, open at one end to the generally V-shaped crossover conduit and at the opposite end to the lower portion of the combustion chamber of the primary heat exchange unit proximate the fuel ash depository;

a fly ash conveyor screw assembly including a fly ash conveyor screw rotatably located in the generally V-shaped crossover conduit and extending through the third crossover conduit operative to move fly ash from the generally V-shaped crossover conduit through the third crossover conduit to be deposited in the ash depository located in the primary heat exchange unit;

means for selective rotation of the fly ash screw conveyor;

vibrating means mounted between adjacent walls of the secondary and tertiary heat exchange units adapted for vibration thereof to dislodge fly ash and cause it to drop by gravity into the generally V-shaped crossover conduit; and flue means communicative with the tertiary heat exchange unit for discharge of products of combustion.

3. The furnace of claim 2 wherein:

said vibrating means includes a strike plate attached between adjacent walls of the secondary and tertiary heat exchange units, a strike hammer mounted on a rod and positioned closely adjacent the strike plate, said rod being connected to a reciprocating motor whereby said hammer vibrates against said strike plate to induce vibration in the walls of the second and tertiary heat exchange units.

4. The hot air furnace of claim 3 including: said furnace cabinet having a blower compartment separated from the furnace compartment by an intermediate wall.

5. The hot air furnace of claim 4 wherein: said fly ash motor is mounted on said intermediate wall in the blower compartment, said rod being connected to said fly ash motor and extending through an opening in the intermediate wall.

6. The hot air furnace of claim 5 including: a cold air intake plenum opening into the blower compartment, a blower located in the blower compartment having a blower outlet disposed in a blower opening in the intermediate wall open to the furnace compartment, a hot air outlet plenum open from the furnace compartment to exhaust air drawn by the blower through the intake plenum and moved into the furnace compartment to be heated by the primary, secondary and tertiary heat exchange units, and an exhaust flue extending from the tertiary heat exchange unit to a location outside of the furnace cabinet.

7. The hot air furnace of claim 2 including: sinuate heat exchanger means located on the primary, secondary and tertiary heat exchange units.

8. The hot air furnace of claim 2 wherein: said heat exchange units have sinuate sidewalls.

9. A hot air furnace for burning solid fuel comprising:

a primary heat exchange unit having walls defining a combustion chamber;

a solid fuel burner assembly located in the combustion chamber;

a fuel ash depository located beneath the burner assembly for collection of ash produced as a result of burning fuel;

a secondary heat exchange unit positioned adjacent the primary heat exchange unit and having walls defining a secondary heat exchange chamber for receipt of products of combustion from the primary heat exchange chamber;

an upper crossover conduit connecting the upper portion of the combustion chamber of the primary heat exchange unit with the upper portion of the chamber of the secondary heat exchange unit for transfer of products of combustion from the combustion chamber to the secondary heat exchange unit;

a tertiary heat exchange unit positioned adjacent the secondary heat exchange unit and having walls defining a tertiary heat exchange chamber;

floor means disposed at the bottom of the secondary and tertiary heat exchange chambers for receipt of fly ash accumulated on the interior walls of the secondary and tertiary heat exchange chambers, said floor means providing a conduit for connection of the secondary and tertiary heat exchange chambers;

a fly ash discharge conduit located below the upper crossover conduit and extended between the primary heat exchange unit and the secondary and tertiary heat exchange units, open at one end to the floor means and at the opposite end to the lower portion of the combustion chamber of the primary heat exchange unit proximate the fuel ash depository;

a fly ash conveyor screw assembly including a fly ash conveyor screw rotatably located proximate the floor means and extending through the fly ash discharge conduit operative to move fly ash from the floor means through the fly ash discharge conduit to be deposited in the ash depository located in the primary heat exchange unit upon rotation of the fly ash conveyor screw;

means for selective rotation of the fly ash conveyor screw;

vibrating means mounted on the outside of a wall of the secondary heat exchange unit adapted for vibration thereof to dislodge fly ash and cause it to drop by gravity to the floor means for conveyance by the fly ash conveyor screw assembly to the fuel ash depository; and flue means communicating with an upper portion of the secondary and tertiary heat exchange units for discharge of products of combustion.

10. The hot air furnace of claim 9 wherein: said floor means includes a generally V-shaped trough.

11. The hot air furnace of claim 10 wherein: said vibrating means includes a strike plate attached to said wall of the secondary heat exchange unit, a strike hammer mounted on a rod and positioned closely adjacent the strike plate, said rod being connected to a reciprocating motor whereby said hammer vibrates against said strike plate to induce vibration in the walls of the secondary heat exchange unit.

12. The hot air furnace of claim 9 including: a tertiary heat exchange unit positioned adjacent the secondary heat exchange unit in facing relationship to the primary heat exchange unit and having walls defining a tertiary heat exchange chamber; said floor means including a lower generally V-shaped crossover conduit connecting the lower portion of the interior of the secondary heat exchange unit to the lower portion of the interior of the tertiary heat exchange unit along the length thereof in the direction facing the primary heat exchange unit, said fly ash discharge conduit communicating with generally V-shaped crossover conduit and extending to the primary heat exchange unit, said fly ash conveyor screw being located in the generally V-shaped crossover conduit and extended through the fly ash discharge conduit.

* * * * *